US007594418B2

(12) United States Patent
Park

(10) Patent No.: US 7,594,418 B2
(45) Date of Patent: Sep. 29, 2009

(54) ARC TYPE BLADE TRANSFER APPARATUS

(76) Inventor: Hong-Soon Park, #104-1401 Shinan Apt., 100 Pungmu-dong, Gimpo-si, Gyeonggi-do (KR) 415-754

( * ) Notice: Subject to any disclaimer, the term of this patent is extended or adjusted under 35 U.S.C. 154(b) by 92 days.

(21) Appl. No.: 11/720,590

(22) PCT Filed: Sep. 21, 2006

(86) PCT No.: PCT/KR2006/003749

§ 371 (c)(1),
(2), (4) Date: May 31, 2007

(87) PCT Pub. No.: WO2007/037603

PCT Pub. Date: Apr. 5, 2007

(65) Prior Publication Data

US 2008/0022743 A1 Jan. 31, 2008

(30) Foreign Application Priority Data

Sep. 29, 2005 (KR) ..... 10-2005-0091086

(51) Int. Cl.
*B21D 5/14* (2006.01)

(52) U.S. Cl. ..... 72/169; 72/166; 72/240; 72/251

(58) Field of Classification Search ..... 72/166, 72/167, 169, 182, 194, 197, 207, 240, 251, 72/248
See application file for complete search history.

(56) References Cited

U.S. PATENT DOCUMENTS 2,771,801 A * 11/1956 Wellman ..... 72/167
3,438,232 A * 4/1969 Achler et al. ..... 72/166
3,623,349 A * 11/1971 Hausier ..... 72/169
5,673,603 A * 10/1997 Aichele ..... 83/344
5,755,131 A * 5/1998 Voth ..... 72/240
6,286,352 B1 * 9/2001 Hackstock ..... 72/167
6,318,141 B1 11/2001 Tokunaga

FOREIGN PATENT DOCUMENTS

JP 59-166324 * 9/1984
JP 4-210836 7/1992
JP 5-261447 10/1993
JP 8-332524 12/1996
KR 10-2003-0025677 11/2004

* cited by examiner

*Primary Examiner*—Edward Tolan
(74) *Attorney, Agent, or Firm*—Merchant & Gould P.C.

(57) ABSTRACT

An arc type blade transfer apparatus is disclosed. The apparatus includes a main body which is formed with a space through which an arc type blade passes, and a transfer roller which is rotatably mounted to the main body and is rotated to transfer the arc type blade. The transfer roller is formed in a truncated-conical shape including a small-diameter end, a large-diameter end and a tapered peripheral surface, and slantedly mounted with respect to a surface of the arc type blade so that the tapered peripheral surface of the transfer roller is in parallel contact with the surface of the arc type blade. Accordingly, the apparatus can transfer the arc type blade having an inner radius and an outer radius, transferring distances of which are different from each other, by one transfer roller, thereby simplifying a structure of the apparatus and accurately transferring the arc type blade.

6 Claims, 3 Drawing Sheets

ARC TYPE BLADE TRANSFER APPARATUS

TECHNICAL FIELD

The present invention relates to an arc type blade transfer apparatus for transferring an arc type blade in a blade bending apparatus, and more particularly to an arc type blade transfer apparatus which can transfer an arc type blade having an inner radius and an outer radius, transferring distances of which are different from each other.

BACKGROUND ART

In general, a blade bending apparatus is an apparatus for continuously bending a strip-shaped blade, which is wound around a roll, by using a bending pin. In order to continuously bend the strip-shaped blade in the blade bending apparatus, it is important to transfer the blade from the roll at an adequate rate. When the strip-shaped blade has a straight shape, the blade is put on a horizontal rotating roller and transferred by a frictional force between a surface of the blade and the roller.

However, in case of an arc type blade 10 illustrated in FIG. 1, because an inner radius r and an outer radius R of the blade are different from each other, it is needed to make the transfer of the inner radius portion and the transfer of the outer radius portion different so as to maintain the shape of the arc type blade as it is. Because the horizontal roller used for transferring the conventional straight type blade has a constant diameter over the whole circumferential surface, the horizontal roller is not useful for transferring the arc type blade which should be transferred under the condition that the transfer of the inner radius portion is different from the transfer of the outer radius portion.

An arc type blade transfer apparatus of a prior art is disclosed in Japanese Patent Laid-open Publication No. 8-332524. As shown in FIG. 2, an arc type blade transfer apparatus of the prior art comprises pressure rollers 700 and 701 for pressurizing the outer peripheral surface of the arc type blade 10, and a driving gear 720 for transferring the arc type blade 10 by being tooth-engaged with slits 11 formed at the inner peripheral surface of the blade 10. Another arc type blade transfer apparatus of a prior art is disclosed in Korean Patent Laid-open Publication No. 10-2003-0025677. As shown in FIG. 3, an arc type blade transfer apparatus of the prior art comprises a transfer unit 800 which holds the arc type blade 10 and is rotated around a center point O.

However, because the prior art transfer apparatus illustrated in FIG. 2 uses the slits 11 formed at the inner peripheral surface of the arc type blade, when a shape of the slits 11 or a gap between the slits 11 is changed, the driving gear 720 should be replaced correspondingly to the changed slits. Also, because the prior art transfer apparatus illustrated in FIG. 3 requires devices for supporting the arc type blade and rotating the transfer unit 800 around the center point, a structure becomes complicated.

DISCLOSURE

Technical Problem

Therefore, the present invention has been made in view of the above problems, and it is an object of the present invention to provide an arc type blade transfer apparatus which provides a transfer roller capable of transferring an arc type blade having an inner radius and an outer radius, transferring distances of which are different from each other, in a circumferential direction, thereby simplifying a structure of a transfer apparatus.

Technical Solution

In accordance with an aspect of the present invention, the above and other objects can be accomplished by the provision of an arc type blade transfer apparatus for transferring an arc type blade having an inner radius and an outer radius, transferring distances of which are different from each other, the apparatus comprising: a main body which is formed with a space through which the arc type blade passes; and a transfer roller which is rotatably mounted to the main body and is rotated to transfer the arc type blade, the transfer roller being formed in a truncated-conical shape including a small-diameter end, a large-diameter end and a tapered peripheral surface formed between the small-diameter end and the large-diameter end, and being slantedly mounted with respect to a surface of the arc type blade so that the tapered peripheral surface of the transfer roller is in parallel contact with the surface of the arc type blade. Accordingly, the arc type blade having the inner radius and the outer radius can be transferred by one transfer roller.

Preferably, a ratio of a circumferential length of the inner radius of the arc type blade to a circumferential length at a small-diameter contact point of the transfer roller with an inner peripheral portion of the arc type blade is equal to a ratio of a circumferential length of the outer radius of the arc type blade to a circumferential length at a large-diameter contact point of the transfer roller with an outer peripheral portion of the arc type blade. Accordingly, the accurate transfer of the arc type blade can be achieved.

Preferably, the main body further includes guide members for supporting and guiding the arc type blade to be transferred. Accordingly, the arc type blade can be smoothly transferred while maintaining the shape of the arc type blade as it is.

Preferably, the main body further includes a pressure roller which is rotatably mounted to the main body on an opposite side of the arc type blade to the transfer roller and pressurizes the arc type blade toward the transfer roller. Accordingly, a frictional force between the transfer roller and the arc type blade can be adequately maintained.

Preferably, the pressure roller is rotatably mounted to an adjusting part which is up/down movably coupled to the main body above the pressure roller. Accordingly, by adjusting the up/down movement of the adjusting part, the pressurizing force of the pressure roller exerted to the arc type blade can be regulated.

Preferably, the apparatus further comprises a driving unit which is connected to a rotating shaft of the transfer roller to rotate the transfer roller which is slantedly mounted.

DESCRIPTION OF DRAWINGS

The above and other objects, features and other advantages of the present invention will be more clearly understood from the following detailed description taken in conjunction with the accompanying drawings, in which.

BEST MODE

Figure 1:
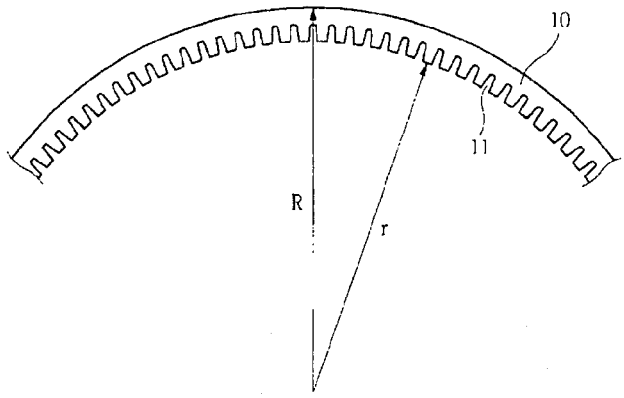
FIG. 1 is a view showing a general arc type blade.
Figure 2:
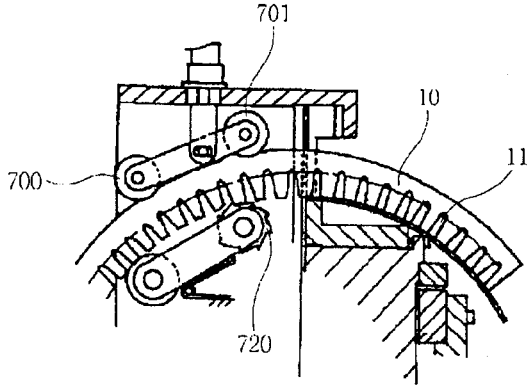
FIG. 2 is a view showing an arc type blade transfer apparatus of a prior art.
Figure 3:
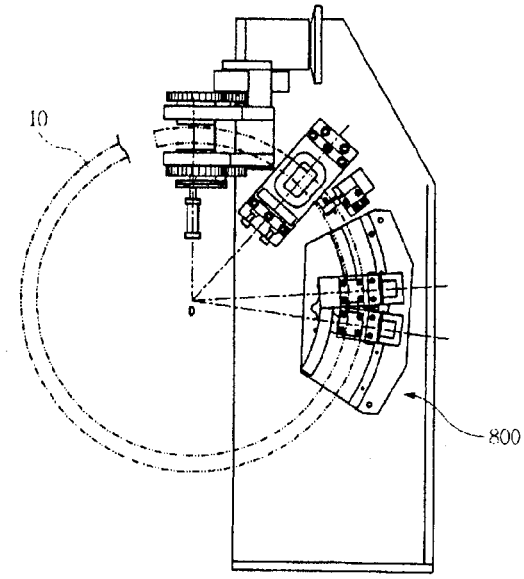
FIG. 3 is a view showing another arc type blade transfer apparatus of a prior art.
Figure 4:
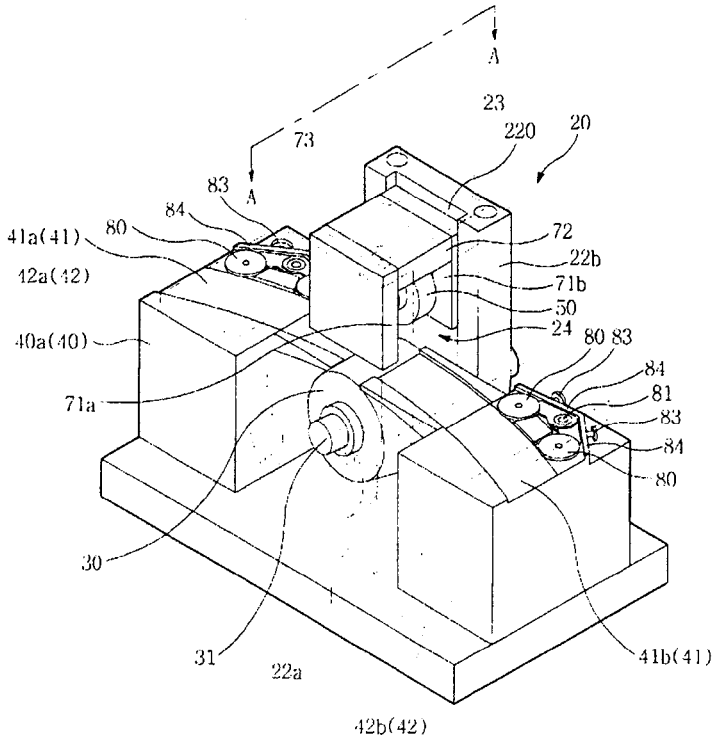
FIG. 4 is a perspective view showing an arc type blade transfer apparatus in accordance with a preferred embodiment of the present invention.
Figure 5:
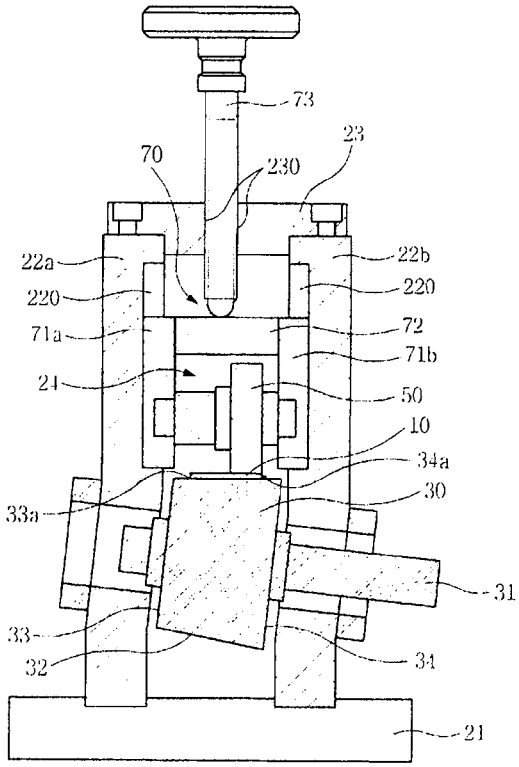
FIG. 5 is a sectional view taken along line A-A in FIG. 4.
Figure 6:
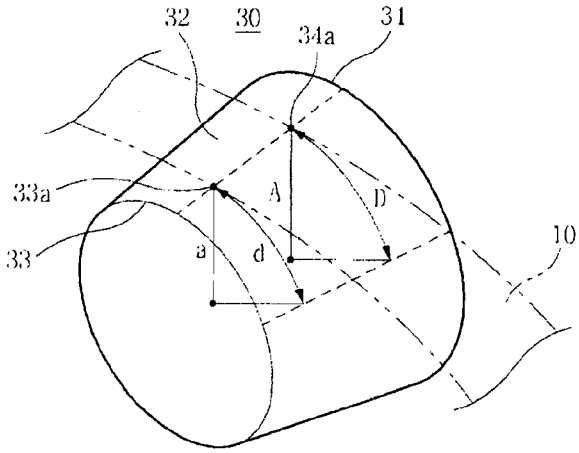
FIG. 6 is a perspective view showing a transfer roller of an arc type blade transfer apparatus in accordance with a preferred embodiment of the present invention.
Figure 7:
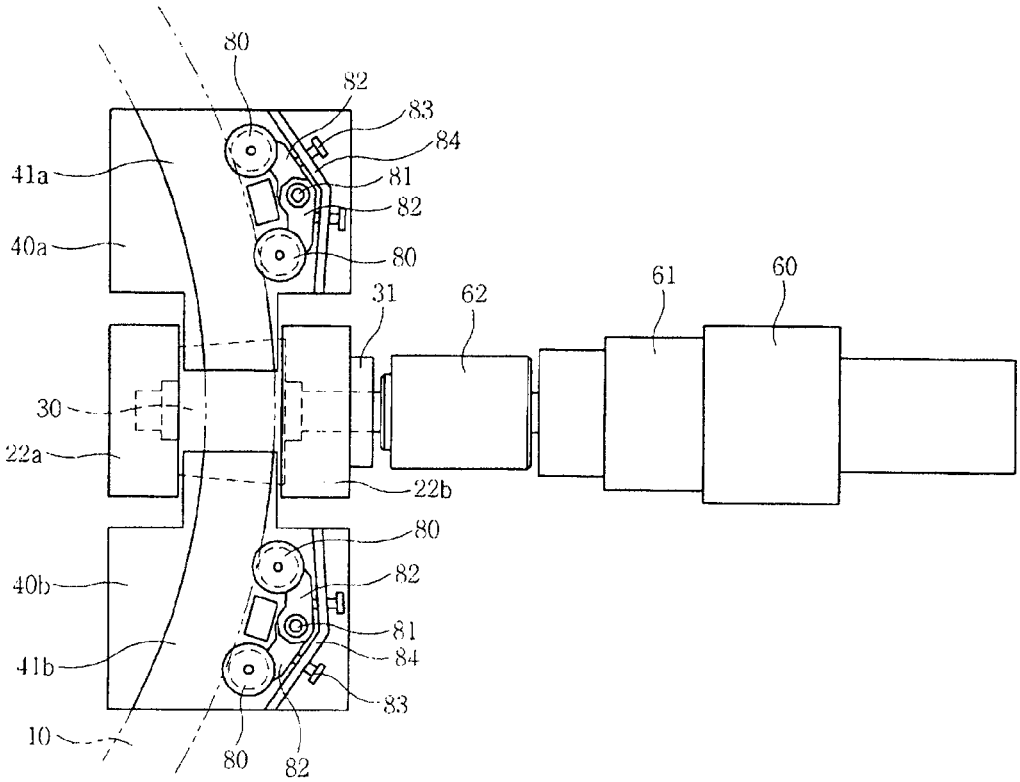
FIG. 7 is a view showing a guide member of an arc type blade transfer apparatus in accordance with a preferred embodiment of the present invention.

Now, preferred embodiments of the present invention will be described in detail with reference to the annexed drawings. FIG. 4 is a perspective view showing an arc type blade transfer apparatus of the present invention, FIG. 5 is a sectional view taken along line A-A in FIG. 4, FIG. 6 is a perspective view showing a transfer roller of an arc type blade transfer apparatus of the present invention, and FIG. 7 is a view showing a guide member of an arc type blade transfer apparatus of the present invention.

Referring to FIG. 4, an arc type blade transfer apparatus of the present invention comprises a main body 20 which includes a base 21 fixedly mounted to a predetermined position, a transfer roller 30 which is mounted to the main body 20 to transfer an arc type blade 10, and guide members 40 which guide the transfer of the arc type blade 10.

The main body 20 includes side supporting blocks 22*a* and 22*b* which are vertically mounted on the base 21, and a top block 23 which is horizontally coupled to upper ends of the side supporting blocks 22*a* and 22*b*, so that the main body 20 has a substantially rectangular parallelepiped shape. The main body 20 is formed with a space 24 thereinside, through which the arc type blade 10 passes.

The guide members 40 (40*a* and 40*b*) for guiding the transferred arc type blade 10 are mounted to the main body 20. In this embodiment, so as to guide and support the arc type blade 10 at both an inlet and an outlet of the main body 20, the first and second guide members 40*a* and 40*b* are mounted to the inlet and the outlet of the main body 20, respectively. However, according to the design, only one guide member may be selectively mounted to the inlet or the outlet of the main body.

The first guide member 40*a* mounted to the inlet and the second guide member 40*b* mounted to the outlet are formed with guide recesses 41 (41*a* and 41*b*) on their upper surfaces, on which the arc type blade 10 is disposed. A part of the guide recess 41*a* of the first guide member and a part of the guide recess 41*b* of the second guide member are protruded inward the space 24 of the main body 20. The guide recesses 41, on which the transferred arc type blade 10 is disposed, have a same curvature as the arc type blade 10. Also, it is preferable to design each of the guide recesses 41 so that an inner radius of the guide recess is equal to an inner radius r of the arc type blade 10. When the inner radius r of the arc type blade 10 is set to be equal to the inner radius of the guide recess, once the arc type blade 10 is loaded such that its peripheral surface contacts the inner peripheral surfaces of the guide recesses 41, the inner peripheral surface of the arc type blade 10 is always kept in contact with the inner peripheral surfaces of the guide recesses 41 during the transfer of the arc type blade 10.

A width of each of the guide recesses 41 is a little larger than a width (a difference between the outer radius R and the inner radius r) of the arc type blade 10. In other words, the inner peripheral surface of the arc type blade 10 contacts the inner peripheral surfaces of the guide recesses 41, while the outer peripheral surface of the arc type blade 10 is spaced apart a small distance from the outer peripheral surfaces of the guide recesses 41, thereby preventing the transfer of the arc type blade 10 from being hindered by the guide recesses 41.

Covers 42 (42*a* and 42*b*) are detachably coupled on the first guide member 40*a* mounted to the inlet and the second guide member 40*b* mounted to the outlet. By removing the covers 42 from the guide members, the arc type blade 10 can be easily loaded on the guide recesses 41. By coupling the covers 42 onto the guide members, the arc type blade 10 is prevented from being separated from the guide recesses 41.

The guide members 40 are detachably mounted onto the base 21 of the main body 20. Accordingly, a variety of guide members, on each of which a guide recess is formed correspondingly to the shape of the arc type blade, are provided, and the guide members can be replaced according to the shape of the arc type blade to be transferred.

A transfer roller 30 is rotatably mounted inside the space 24 of the main body 20, to contact a surface of the arc type blade 10. In this embodiment, the transfer roller 30 is mounted in a lower portion of the space 24 between the first guide member 40*a* and the second guide member 40*b*, and can be rotated with respect to the main body 20. As shown in FIGS. 5 and 6, the transfer roller 30 is formed in a truncated-cone shape, which has a tapered peripheral surface 32. In other words, a diameter of one end 33 (a small-diameter end) of the transfer roller is different from a diameter of the other end 34 (a large-diameter end). Accordingly, when the transfer roller 30 is rotated, a peripheral moving distance d of a contact point 33*a* (hereinafter, which will be called a "small-diameter contact point") between the inner peripheral portion of the arc type blade 10 and the peripheral surface near the small-diameter end 33 of the transfer roller 30 is different from a peripheral moving distance D of a contact point 34*a* (hereinafter, which will be called a "large-diameter contact point") between the outer peripheral portion of the arc type blade 10 and the peripheral surface near the large-diameter end 34 of the transfer roller 30.

The present invention applies the above features, of that there is a difference between the peripheral moving distance d of the small-diameter contact point 33*a* and the peripheral moving distance D of the large-diameter contact point 34*a*, to the transfer of the arc type blade. For this, the transfer roller 30 is mounted to the main body 20 in such a manner that a rotating shaft 31 of the transfer roller 30 is slanted with respect to the surface of the arc type blade 10 which contacts the transfer roller 30. In other words, the transfer roller 30 is slantedly mounted so that the inner peripheral portion of the arc type blade 10 contacts the small-diameter contact point 33*a* of the transfer roller 30 and the outer peripheral portion of the arc type blade 10 contacts the large-diameter contact point 34*a* of the transfer roller 30. Accordingly, the tapered peripheral surface 32 of the transfer roller 30 comes into contact with the overall surface of the arc type blade 10. As a result, the arc type blade having the inner radius and the outer radius, the transferring distances of which are different from each other, can be transferred by the rotation of the transfer roller 30.

In order to accurately transfer the arc type blade 10, an inclination of the tapered peripheral surface 32 of the transfer roller 30, i.e., a mounting inclination of the transfer roller 30 should have a prescribed relation with the inner radius and the outer radius of the arc type blade 10. In particular, a circumferential length of the inner radius r of the arc type blade 10 is in proportion to a circumferential length at the small-diameter contact point 33*a* of the transfer roller 30, and a circumferential length of the outer radius R of the arc type blade 10 is in proportion to a circumferential length at the large-diameter contact point 34*a* of the transfer roller 30. Preferably, the above two proportional relationships have the same ratio so that the arc type blade 10 can be transferred by the rotation of the transfer roller 10.

In this embodiment, the circumferential length of the inner radius r of the arc type blade 10 is ten times larger than the circumferential length at the small-diameter contact point 33*a* of the transfer roller 30, and the circumferential length of the outer radius R of the arc type blade 10 is ten times larger than the circumferential length at the large-diameter contact point 34*a* of the transfer roller 30. In other words, while the transfer roller 30 is rotated ten times, the arc type blade 10 is transferred by one rotation around a center point O. Accordingly, based on the circumferential lengths at the small-diameter contact point 33*a* and the large-diameter contact point 34*a* of the transfer roller, respectively, which are decided by the inner radius r and the outer radius R of the arc type blade 10, a radius a at the small-diameter contact point 33*a* and a radius A at the large-diameter contact point 34*a* can be determined, and other dimensions necessary for manufacturing the transfer device, such as the inclination of the tapered peripheral surface of the transfer roller 30 adequate for the transfer of the arc type blade 10, are determined.

Further, so as to transfer the arc type blade 10 by the transfer roller 30, the mounting inclination of the transfer roller 30 with respect to the main body 20 is set to be equal to the inclination of the tapered peripheral surface 32 of the transfer roller 30 so that the tapered peripheral surface 32 of the transfer roller 30 is in parallel with the surface of the arc type blade 10. Accordingly, the inclination of the tapered peripheral surface of the transfer roller 30 becomes the inclination of the transfer roller 30 with respect to the main body 20. Also, in order to slantedly mount the transfer roller 30, as shown in FIG. 5, the side supporting blocks 22*a* and 22*b* of the main body 20 may be modified to have slanted surfaces which are perpendicular to the rotating shaft 31.

The rotating shaft 31 of the transfer roller 30, as shown in FIG. 7, is driven by a driving unit 60 like a motor or the like, and a reduction gear 61 and a coupling 62 are mounted between the rotating shaft 31 and the driving unit 60 to adequately adjust the rotation of the transfer roller 30.

Referring to FIGS. 4 and 5, the arc type blade 10 disposed on the transfer roller 30 is pressurized by a pressure roller 50 which is mounted to an upper portion of the main body 20. By the pressurizing force of the pressure roller 50, a frictional force between the transfer roller 30 and the arc type blade 10 can be adequately maintained, so that the rotating force of the transfer roller 30 is exerted on the arc type blade 10. The pressure roller 50 is rotatably mounted to an adjusting part 70 which is up/down movably coupled to the main body 20. Accordingly, the pressure roller 50 is rotated by friction with the transferred arc type blade 10, and does not affect the transfer of the arc type blade 10. The pressure roller 50 may be a horizontal roller, or a truncated-conical roller which has the same inclination as the transfer roller 30 and is slantedly mounted with respect to the main body. Such a pressure roller 50 has a function of pressurizing the arc type blade 10 toward the transfer roller 30. In this embodiment, the horizontal roller is used as the pressure roller 50 because the pressure roller 50 is in line-contact with the arc type blade 10 and does not affect the transfer of the arc type blade 10.

Also, as shown in FIG. 5, the pressure roller 50 is designed to contact only a portion of the arc type blade 10. If the pressure roller 50 pressurizes the overall surface of the arc type blade 10, the arc type blade 10 may be pressed and deformed so that the inner radius and the outer radius are changed. It is preferable that the pressure roller 50 pressurizes a portion near the outer periphery (i.e., a portion where the slits 11 are not formed) of the arc type blade 10. If the pressure roller 50 pressurizes the portion where the slits 11 are formed, the pressure roller 50 cannot always constantly pressurize the arc type blade 10 by the slits 11.

The adjusting part 70 includes side plates 71*a* and 71*b* which are mounted to move up and down along guide recesses 220 formed at the side supporting blocks 22*a* and 22*b* of the main body 20, and a top plate 72 coupled to upper ends of the side plates 71*a* and 71*b*. A rotating shaft 51 of the pressure roller 50 is rotatably mounted to the side plates 71*a* and 71*b* of the adjusting part 70. The top block 23 of the main body 20 is formed with a through-hole 230. A pressure rod 73 is screw-coupled to the through-hole 230 to move up and down by the rotation, and pressurizes the top plate 72 of the adjusting part 70. By rotating the pressure rod 73 to adjust the up/down movement of the adjusting part 70, the pressurizing force of the pressure roller 50 exerted to the arc type blade 10 is regulated.

At least one separation-preventing member 80 is mounted to a side of each of the guide recesses 41 formed at the guide members 40. In this embodiment, because the inner peripheral surface of the arc type blade 10 comes into contact with the inner peripheral surfaces of the guide recesses 41 and the outer peripheral surface of the arc type blade 10 is spaced apart a small distance from the outer peripheral surfaces of the guide recesses 41, the separation-preventing members 80 are positioned near the outer periphery of the guide recesses 41 and support the outer peripheral surface of the arc type blade 10. As shown in FIGS. 4 and 7, a roller is used as the separation-preventing member 80. Two separation-preventing members 80 are provided near the outer periphery of the guide recess 41*a* of the first guide member 40*a* mounted to the inlet, and two separation-preventing members 80 are provided near the outer periphery of the guide recess 41*b* of the second guide member 40*b* mounted to the outlet. The separation-preventing members 80 are rotatably coupled to ends of supporting brackets 82. The supporting brackets 82 are rotatably mounted about supporting shafts 81 which are vertically mounted on the guide members 40, and elastically supported by elastic members (not shown). Thus, after the supporting brackets 82 are rotated about the supporting shafts 81, the supporting brackets 82 can return to original positions by the elastic restoring force of the elastic members.

The rotation of the supporting members 82 about the supporting shafts 81 is performed by position adjusting members 83. The position adjusting members 83 are screw-coupled to fixing plates 84 which are fixed on the guide members 40, and move forward and backward by the rotation to pressurize the supporting members 82 toward the guide recesses 41. Accordingly, by adjusting the forward/backward movement of the position adjusting members 83 to pressurize the supporting members 82, the supporting members 82 are rotated about the supporting shafts 81, and the separation-preventing members 80 come into contact with the outer peripheral surface of the arc type blade 10. As a result, the separation-preventing members 80 do not only support the outer periphery of the arc type blade 10 but also prevent the arc type blade 10 from being separated from the guide recesses 41.

Hereinafter, an operation of the arc type blade transfer apparatus according to the present invention will be described. The arc type blade 10 is put on the guide recesses 41 of the guide members 40, and the guide members 40 are covered by the covers 42. By adjusting the movement of the position adjusting members 83 so that the separation-preventing members 80 support the outer peripheral surface of the arc type blade 10, the position of the arc type blade 10 in the guide recesses 41 is adjusted in the radial direction. By rotating the pressure rod 73 to adjust the up/down movement of the adjusting part 70, the pressurizing force of the pressure roller 50 exerted to the arc type blade 10 and the vertical position of the arc type blade 10 are adjusted.

Then, the driving unit 60 is driven to rotate the transfer roller 30, and the arc type blade 10 which is in contact with the transfer roller 30 is transferred along the guide recesses 41 of the guide members 40. Since the transfer roller 30 is formed in the truncated-cone shape which has the tapered peripheral surface corresponding to the shape of the arc type blade 10, the transfer roller 30 can transfer the arc type blade 10 having the inner radius and the outer radius, the transferring distances of which are different from each other.

INDUSTRIAL APPLICABILITY

As apparent from the above description, since the arc type blade transfer apparatus in accordance with the present invention can transfer the arc type blade having the inner radius and the outer radius, the transferring distances of which are different from each other, by one transfer roller, the structure of the transfer apparatus can be simplified.

Also, since the inclination of the tapered peripheral surface of the transfer roller is determined correspondingly to the shape of the arc type blade and the transfer roller is slantedly mounted so that the overall surface of the arc type blade contacts the tapered peripheral surface of the transfer roller, the accurate transfer of the arc type blade can be achieved.

Also, since the arc type blade transferred along the guide recesses is kept to be disposed at constant position in the guide recesses by the pressure roller and the separation-preventing members, the arc type blade can be always regularly transferred.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

The invention claimed is:

1. An arc type blade transfer apparatus for transferring an arc type blade having an inner radius and an outer radius, transferring distances of which are different from each other, the apparatus comprising:

a main body which is formed with a space through which the arc type blade passes without the shape of the arc type blade being changed; and a transfer roller which is rotatably mounted to the main body and is rotated for transferring the arc type blade while maintaining the shape of the arc type blade, the transfer roller being formed in a truncated-conical shape including a small-diameter end, a large-diameter end and a tapered peripheral surface formed between the small-diameter end and the large-diameter end, and being slantedly mounted with respect to a surface of the arc type blade so that the tapered peripheral surface of the transfer roller is in parallel contact with the surface of the arc type blade while transferring distances differentiated by the tapered peripheral surface of the transfer roller are transmitted to the arc type blade which has varied transferring distances along its radius.

2. The apparatus according to claim 1, wherein a ratio of a circumferential length of the inner radius of the arc type blade to a circumferential length at a small-diameter contact point of the transfer roller with an inner peripheral portion of the arc type blade is equal to a ratio of a circumferential length of the outer radius of the arc type blade to a circumferential length at a large-diameter contact point of the transfer roller with an outer peripheral portion of the arc type blade.

3. The apparatus according to claim 1, wherein the main body further includes guide members for supporting and guiding the arc type blade to be transferred.

4. The apparatus according to claim 1, wherein the main body further includes a pressure roller which is rotatably mounted to the main body on an opposite side of the arc type blade to the transfer roller and pressurizes the arc type blade toward the transfer roller.

5. The apparatus according to claim 4, wherein the pressure roller is rotatably mounted to an adjusting part which is up/down movably coupled to the main body above the pressure roller.

6. The apparatus according to claim 1, further comprising:

a driving unit which is connected to a rotating shaft of the transfer roller to rotate the transfer roller which is slantedly mounted.

* * * * *